US010947074B2

(12) United States Patent
Templeman et al.

(10) Patent No.: US 10,947,074 B2
(45) Date of Patent: Mar. 16, 2021

(54) NOTE VALIDATOR TRANSPORT PATH CENTRALIZER

(71) Applicant: NCR Corporation, Atlanta, GA (US)

(72) Inventors: Robert Templeman, Cowdenbeath (GB); Peer-Ake Eskelius, Jarfalla (SE)

(73) Assignee: NCR Corporation, Atlanta, GA (US)

( * ) Notice: Subject to any disclaimer, the term of this patent is extended or adjusted under 35 U.S.C. 154(b) by 88 days.

(21) Appl. No.: 16/117,246

(22) Filed: Aug. 30, 2018

(65) Prior Publication Data

US 2020/0071104 A1 Mar. 5, 2020

(51) Int. Cl.
*B65H 9/00* (2006.01)
*B65H 7/10* (2006.01)

(52) U.S. Cl.
CPC ..... *B65H 9/002* (2013.01); *B65H 7/10* (2013.01); *B65H 2701/1912* (2013.01)

(58) Field of Classification Search
CPC ..... G07D 11/16; G07D 11/17; G07D 11/165; B65H 9/002
See application file for complete search history.

(56) References Cited

U.S. PATENT DOCUMENTS

| | | | | |
|---|---|---|---|---|
| 9,868,604 | B2 * | 1/2018 | Repetyuk | G07D 7/17 |
| 10,370,212 | B1 * | 8/2019 | Atwood | G03G 15/6567 |
| 2013/0334770 | A1 * | 12/2013 | Fehrenbach | B65H 5/062 271/228 |
| 2016/0052738 | A1 * | 2/2016 | Park | B65H 5/06 271/227 |

* cited by examiner

*Primary Examiner* — Thomas A Morrison
(74) *Attorney, Agent, or Firm* — Scwegman, Lundberg & Woessner

(57) ABSTRACT

Various embodiments herein each include at least one of systems, assemblies, devices, components, methods, software and firmware for a note validator transport path centralizer, such as may be present in a Self-Service Terminal, e.g., an Automated Teller Machine. One example method embodiment includes receiving a note by a receiving and transport module of a note validator and sensing a lateral positioning of the note on a transport path of the note validator. This method further includes engaging at least one centralizing mechanism to move the note to a medial position on the transport path of the note validator and disengaging the at least one centralizer mechanism upon sensing the note reaching the medial position on the transport path of the note validator. The method may then output the note from the receiving and transport module of the note validator to a note validation module.

14 Claims, 8 Drawing Sheets

NOTE VALIDATOR TRANSPORT PATH CENTRALIZER

BACKGROUND INFORMATION

Self-service terminals (SSTs), such as Automatic Teller Machines (ATMs), Self-Service Checkout (SSCO) terminals, airline check-in kiosks, and other such terminals, are becoming increasingly functional. In particular, various notes may now be presented to and received by such SSTs. These notes, which may be currency, checks, vouchers, coupons, and other documents, can be of varied size which presents note validation challenges.

SUMMARY

Various embodiments herein each include at least one of systems, assemblies, devices, components, methods, software and firmware for a note validator transport path centralizer, such as may be present in an SST, e.g., an ATM or SSCO terminal.

One example method embodiment includes receiving a note by a receiving and transport module of a note validator and sensing a lateral positioning of the note on a transport path of the note validator. This method further includes engaging at least one centralizing mechanism to move the note to a medial position on the transport path of the note validator and disengaging the at least one centralizer mechanism upon sensing the note reaching the medial position on the transport path of the note validator. The method may then output the note from the receiving and transport module of the note validator to a note validation module.

Another method embodiment includes sensing a lateral positioning of a note on a transport path of an SST note validator module that includes two groups of a plurality of omnidirectional wheels, the first and second groups of omnidirectional wheels operative to move the note in perpendicular directions. This method also includes moving the note along the transport path with a first group of omnidirectional wheels and engaging at least one centralizing mechanism that includes the second group of omnidirectional wheels to move the note to a lateral medial position on the transport path of the note validator. The lateral medial position in such embodiments, is centered laterally within the width of and perpendicular to the transport path. The method then disengages the at least one centralizer mechanism upon sensing the note reaching the lateral medial position on the transport path of the note validator and outputs the note from the receiving and transport module of the note validator to a note validation module.

A further example embodiment, in the form of a note transport mechanism of an SST includes a transport path defined by two opposing mechanisms and two groups of a plurality of omnidirectional wheels operative to move the note in perpendicular directions within the transport path. The note transport mechanism of such embodiments also includes at least one sensor to sense a position of a note laterally in relation to a medial position on the transport path. Such embodiments also include a ball transfer unit located opposite each of the omnidirectional wheels of both the first and second groups to apply a spring-biased pinching force against a respective omnidirectional wheel. In such embodiments, the ball transfer units opposite the omnidirectional wheels of the first group are continually biased there against and the ball transfer units opposite the omnidirectional wheels of the second group are selectively biased there against to move a note perpendicular to the transport path to a medial position. The note transport mechanism further includes a controller to receive input from the at least one sensor regarding a position of a note on the transport path and to send signals to one or more ball transfer units to selectively apply a biasing force against one or more omnidirectional wheels of the second group to move a note laterally on the transport path to a medial position.

DETAILED DESCRIPTION

Figure 1:
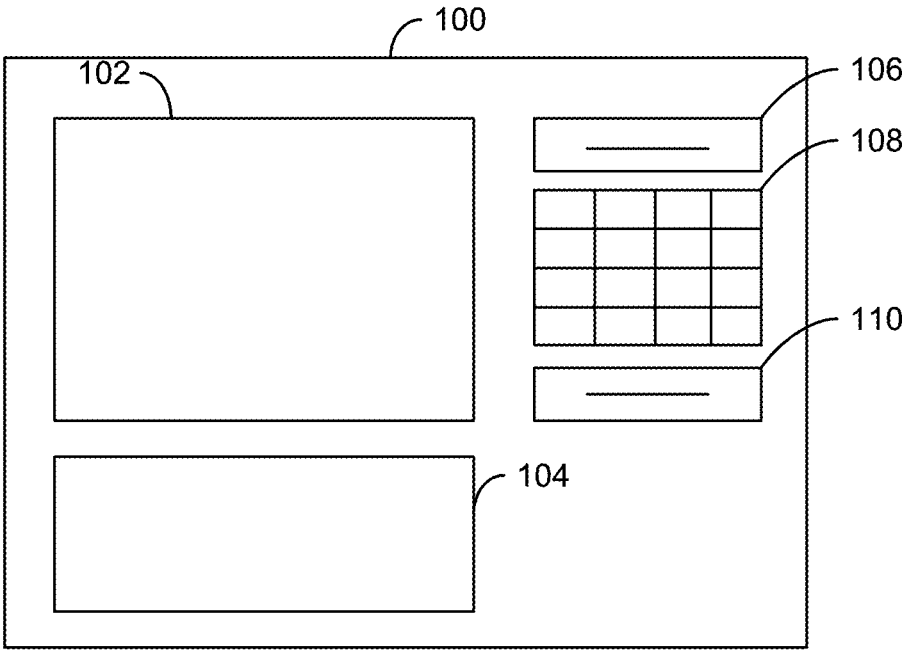
FIG. 1 is an example illustration of a user-facing portion of a Self-Service Terminal (SST) such as an Automated Teller Machine, according to an example embodiment.

Various embodiments herein each include at least one of systems, assemblies, devices, components, methods, software, and firmware for a note validator transport path centralizer, such as may be present in an SST, e.g., an ATM or SSCO terminal. As SSTs become increasingly functional, increasing need for additional functionality arises. In particular, various notes may now be presented to and received by such SSTs. These notes, which may be currency, checks, vouchers, coupons, and other documents, can be of varied size which presents note validation challenges. As notes may be of various sizes, note validators must be able to accept notes of different sizes. This means that not only must the note validator be sized at least as large as the largest note size to be received, all devices involved in receiving and transporting notes to the note validator must be at least equally sized.

However, when receivable size of notes is larger than some of the notes that may be received, other issues arise. Notes may be received off center which can present note validation challenges and challenges handling received notes, such as for placement in a note bin. The present embodiments provide solutions to such challenges with a centralizing capability to move notes to a medial position within a transport path of a note transport module that receives notes and provides then to a note validator in a normalized manner. While such embodiments herein are described as being centralized, other embodiments are contemplated such that notes may instead be moved to other locations in a transport path, such as fully or partially in one direction or another within the transport path.

These and other embodiments are described herein with reference to the figures.

In the following detailed description, reference is made to the accompanying drawings that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims.

The functions or algorithms described herein that control or are involved in controlling a transport module, a note validator, an SST, or one or more other devices relevant to the various embodiments may be implemented in hardware, software or a combination of software and hardware in one embodiment. The software comprises computer executable instructions stored on computer readable media such as memory or other type of storage devices. Further, described functions may correspond to modules, which may be software, hardware, firmware, or any combination thereof. Multiple functions are performed in one or more modules as desired, and the embodiments described are merely examples. The software is executed on a digital signal processor, ASIC, microprocessor, or other type of processor operating on a system, such as a personal computer, server, a router, or other device capable of processing data including network interconnection devices.

Some embodiments implement the functions in two or more specific interconnected hardware modules or devices with related control and data signals communicated between and through the modules, or as portions of an application-specific integrated circuit. Thus, the exemplary process flow is applicable to software, firmware, and hardware implementations.

FIG. 1 is an example illustration of a user-facing portion of a Self-Service Terminal (SST) such as an ATM 100, according to an example embodiment. The ATM includes a display 102 that present information and user interfaces to a user. The display 102 may be a touch screen that is capable of receiving touch input from users. The ATM 100 may also include a card reader 106 to read bank cards, a personal identification number (PIN) pad 108 which is typically an encrypting PIN pad, and a receipt printer and output device 110. The ATM 100 further includes a note dispenser and receiver 104. In the illustrated embodiment of the ATM 100, the note dispenser and receiver 104 are combined into a single device, such as bin as are becoming more common on modern ATMs. Regardless, for purposes of the contributions herein, the note dispenser and received 104 is representative of a terminal device that receives notes from users. The notes may be currency notes of various denominations, checks, vouchers, tickets, and other documents. Notes that are received may be of various sizes, thickness, and material.

When notes are received by the note dispenser and receiver 104, or other receiving device, the notes are then transported by a transport module of a note validator. The subsequent figures and description thereof provide further detail with regard to transport modules.

Figure 2:
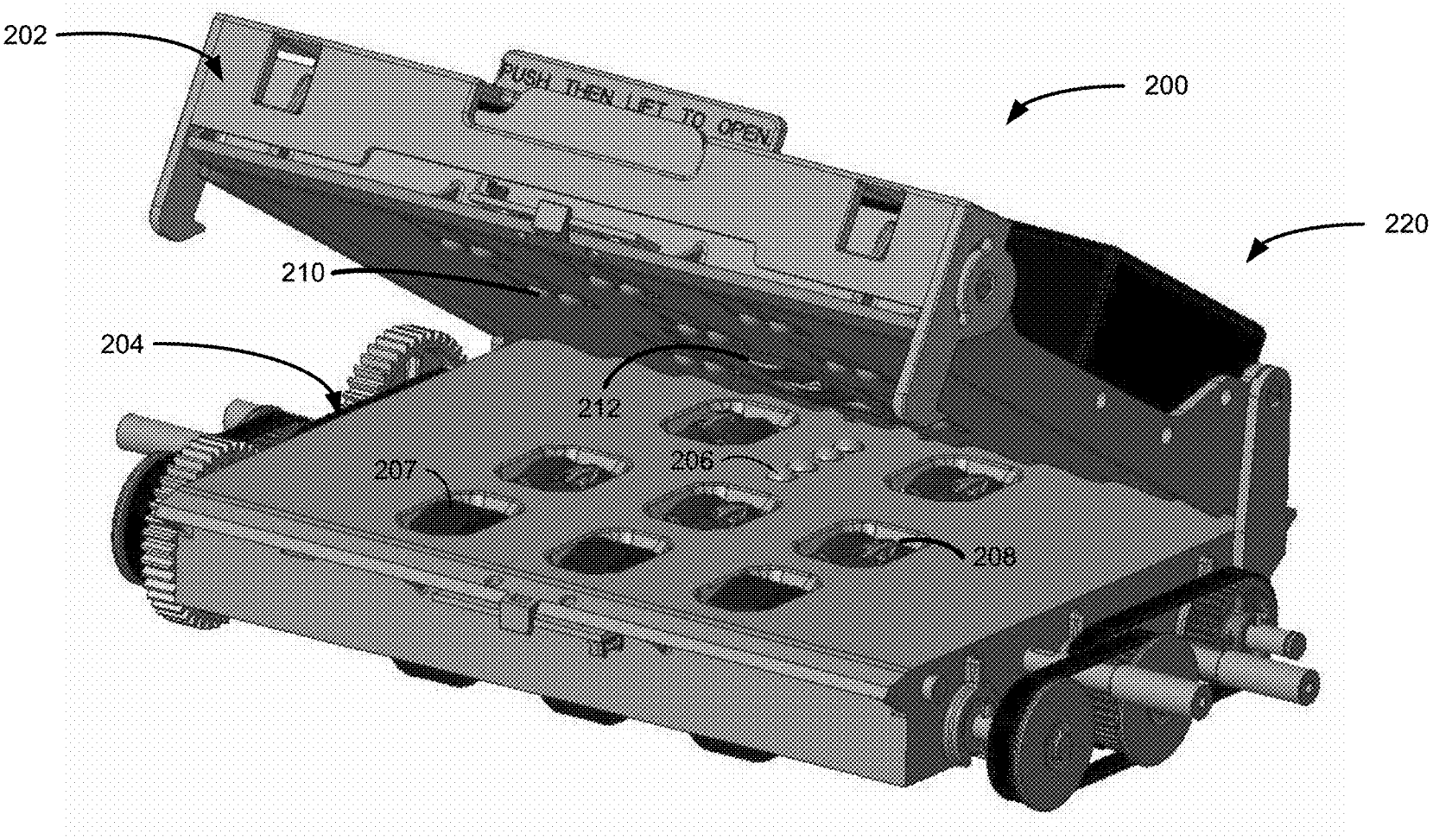
FIG. 2 is a first perspective view of a transport module of an SST note validator, according to an example embodiment.

FIG. 2 is a first perspective view of a transport module 200 of an SST note validator, according to an example embodiment. The transport module 200 is operative to receive a note from an SST note receiving device and transport the note to a note validator. The transport module 200 performs this function, but is also includes at least one sensor to sense a lateral position of a note being transported along a transport path. The lateral position is perpendicular to the travel path. The at least one sensor may include one or more of optical sensors, pressure sensors, and the like. Signals from the one or more sensors are provided to a controller of the transport module 200, which may be a part of the transport module 200, part of the note validator, performed as a function of the terminal in which the transport module is deployed, or elsewhere. When the controller determines from the signals that a note is laterally off-center or other desired position the controller instructs the transport module 200 to move the note being transported laterally in relation to the transport path toward the desired position. When the note reaches the desired lateral position, the controller may instruct the transport module 200 accordingly. However, in other embodiments, when the controller instructs the transport module to move the note laterally, that may be the only needed instruction as the desired position may be fully in one direction or the instruction may include a distance to move the note. Regardless, the note is then in the desired position and the transport module 200 may then move the note fully through the transport path to the note validator.

The transport module 200 as illustrated in FIG. 2 is in an open position. An upper portion 202 is lifted from a lower portion 204. The transport module 200 includes the at least one sensor 220 to sense the lateral position of a note being transported along the transport path. As mentioned above, the at least one sensor 220 may include one or more of optical sensors, pressure sensors, and the like.

The lower portion 204 of the transport module 200 includes a number of wheels 207 at a mouth of the transport module 200 to pull a note into the transport module 200 transport path. The transport module 200 further includes a plurality of omnidirectional directional wheels 208 that are rotated by a motor to move notes along the transport path but are also allowed to spin freely laterally to the transport path. An example embodiment of an omnidirectional wheel is illustrated by the omnidirectional wheel 700 of FIG. 7.

The omnidirectional wheels 208 of the lower portion 204 of the transport module 200 are opposed on the upper portion 202 by a ball transfer unit 210 that freely spins and applies a force biased against the respective omnidirectional wheel 208 when the transport module 200 is closed. Despite the biasing of the ball transfer unit 210, such as by a spring, against the omnidirectional wheel 208, the biasing force allows the ball transfer unit 210 to be pressed way from the omnidirectional when as a note is present.

The upper portion 202 of the transport module 200 also includes at least one omnidirectional wheel 212. The omnidirectional wheel 212 is also opposed in the lower portion 204 by at least one ball transfer unit 206. However, the at least one omnidirectional wheel 212 is mounted to turn perpendicular to the omnidirectional wheels 208 of the lower portion 204 and the transport path of the transport module 200. This allows the at least one omnidirectional wheel 212 of the upper portion to move a note laterally on the transport path.

In some embodiments, the at least one omnidirectional wheel 212 of the upper portion 202 is selectively powered by a motor and instructed to rotate in one of two opposite directions to move a note being transported in an appropriate direction. In other embodiments, there may be two sets of at least one omnidirectional wheel 212 and suitable opposing ball transfer units 206. The two sets of at least one omnidirectional wheel 212 may each rotate in a single direction that is opposite the other group. Thus, when a note needs to be moved in a first direction, the first group is powered to do so and the second is not and vice versa. In some other embodiments, the arrangement may be virtually identical to the two groups of at least one omnidirectional wheel 212, but the omnidirectional wheels may always rotate in their opposing directions, at least when a note is present within the transport module 200. However, the ball transfer units 206 in such embodiments may be raised and lowered through activation of a solenoid that moves a carriage that houses one or more of the ball transfer units 206. When raised, the ball transfer units 206 cause pressure to be applied to a note to press the note against the appropriate omnidirectional wheel 212 to cause the note to be moved in the appropriate lateral direction.

Figure 3:
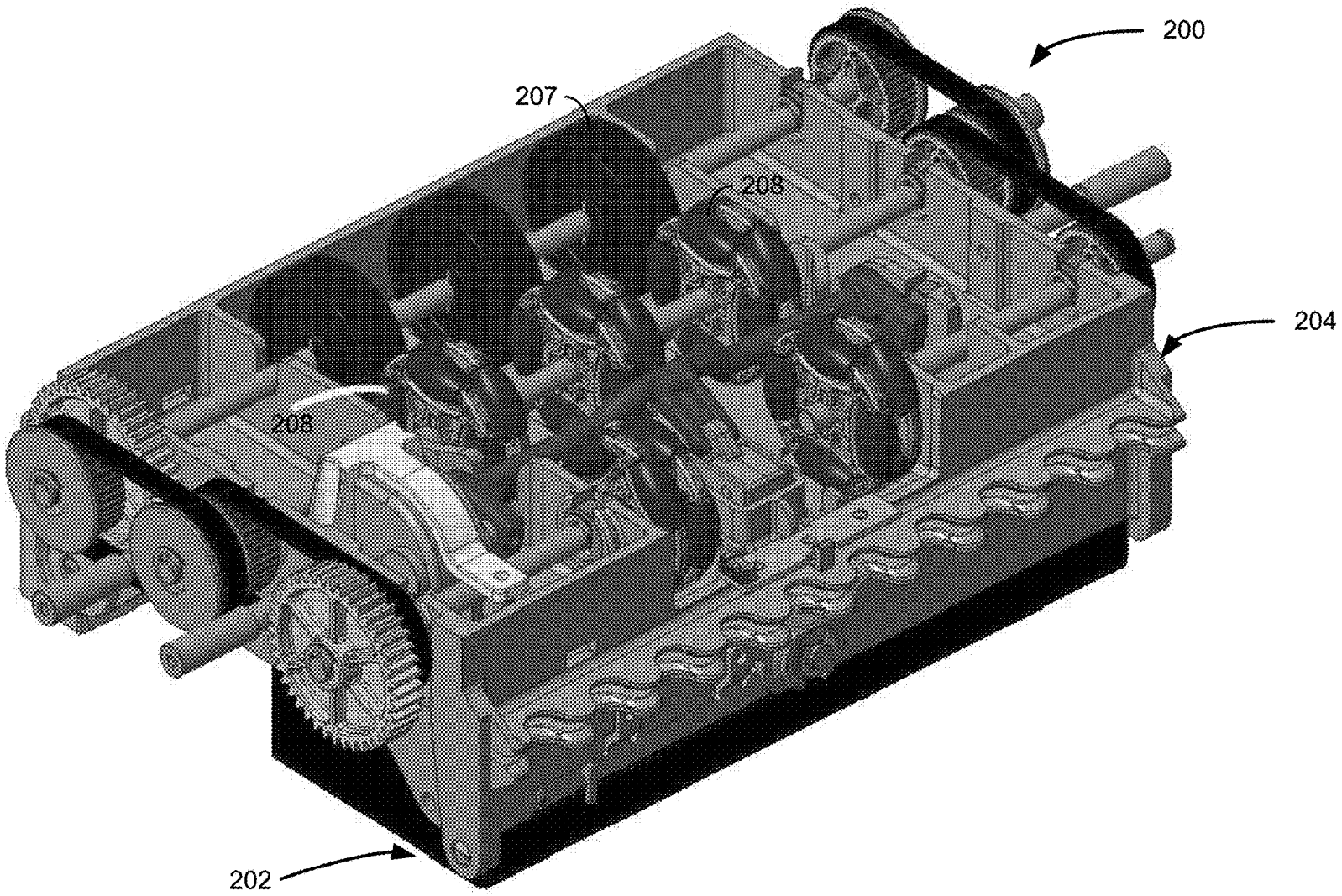
FIG. 3 is a second perspective view of the transport module of FIG. 2, according to an example embodiment.

FIG. 3 is a second perspective view of the transport module 200 of FIG. 2, according to an example embodiment. The transport module 200 in FIG. 3 is illustrated in a closed position with a view of an underside of the lower portion 204 and the wheels 207 and omnidirectional wheels 208.

Figure 4:
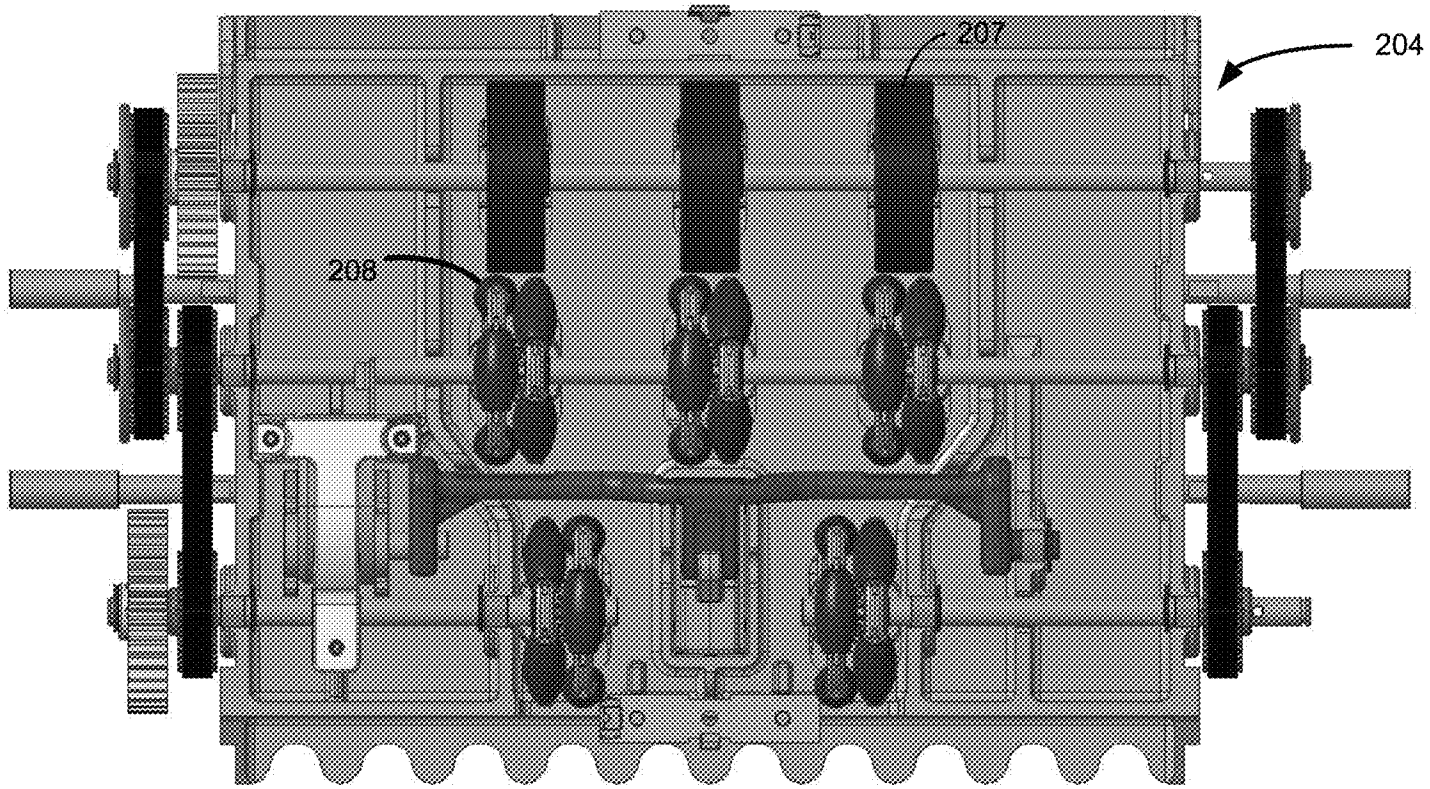
FIG. 4 is an outside view of a first side of a transport module of an SST, according to an example embodiment.

FIG. 4 is an outside view of a first side of a transport module 200 of an SST, according to an example embodiment. The first side illustrated is of the lower portion 204 of the transport module 200.

Figure 5:
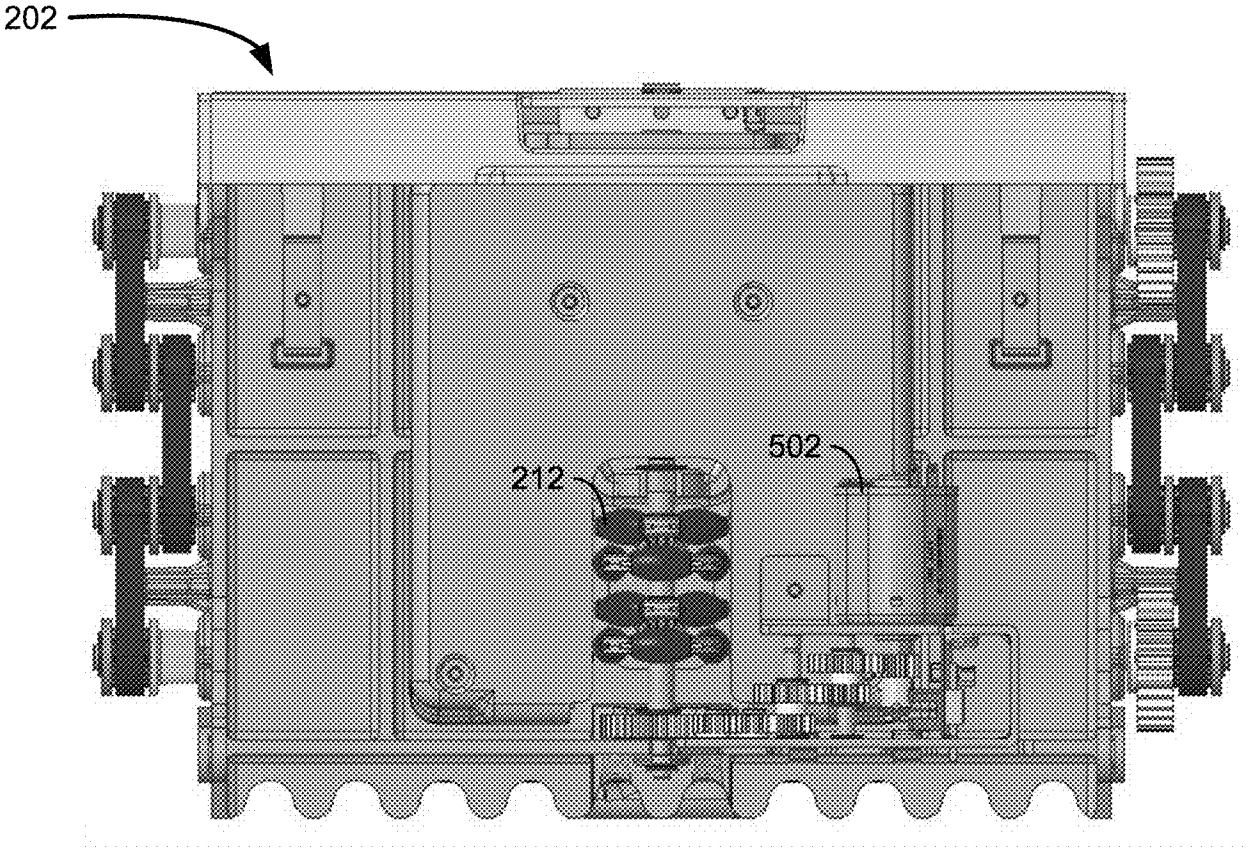
FIG. 5 is an outside view of a second side of a transport module of that is opposite the first side of the transport module of the SST of FIG. 4, according to an example embodiment.

FIG. 5 is an outside view of a second side of a transport module 200 of that is opposite the first side of the transport module of the SST of FIG. 4, according to an example embodiment. The second side illustrated is of the upper portion of the transport module 200 and includes a view of the omnidirectional wheels 212 and motor 502.

Figure 6:
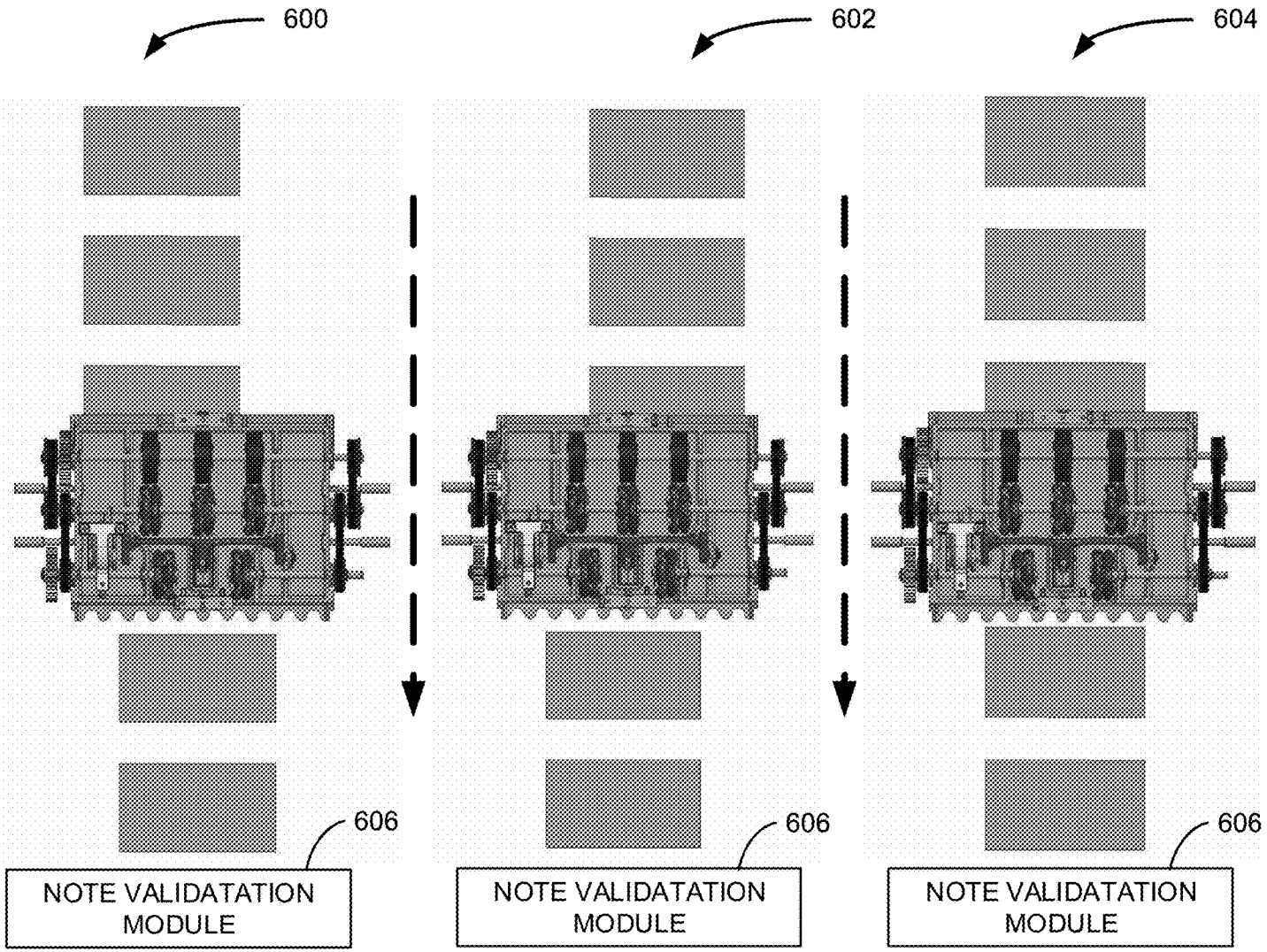
FIG. 6 illustrates three example use cases for input and output of a transport module, according to example embodiments.

FIG. 6 illustrates three example use cases for input and output of a transport module 200, according to example embodiments. Each of the illustrated use cases show a note flowing into the transport path from the top, through a transport module, such as the transport module 200 of FIG. 2 through FIG. 5, and out toward the bottom, such as to a bill validator, e.g., a note validation module 606. A first use case 600 shows a note at the top and offset to the left. As the note flows through the transport module, the note is shifted right to a medial position in the transport path. Similar in the second use case 602, the note at the top is offset to the right. The note is shifted to the medial position by the transport module and output. The last use case 604 requires now shifting of the note.

Figure 7:
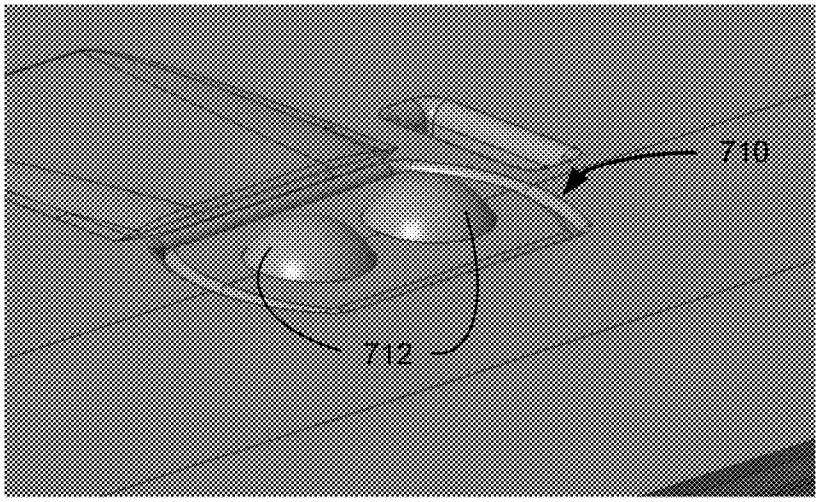
FIG. 7 illustrates omnidirectional wheels, ball transfer units, and operation thereof according to some example embodiments.
Figure 7:
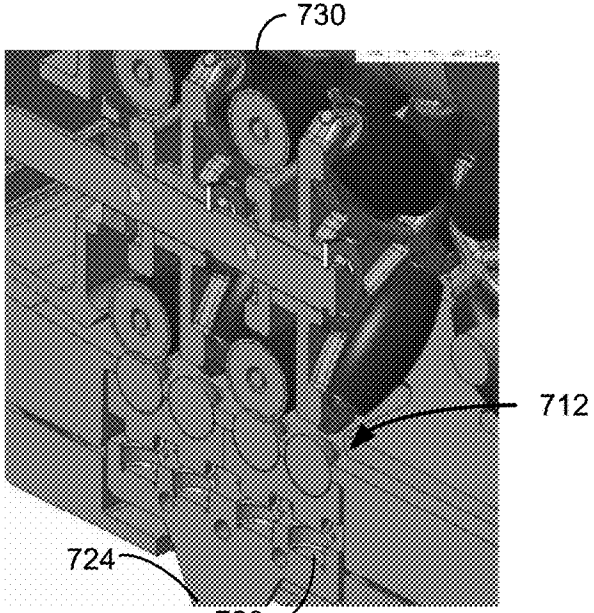
Figure 7:
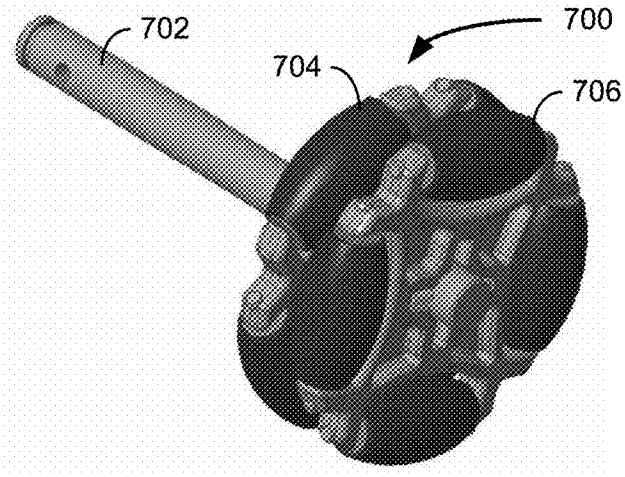
Figure 7:
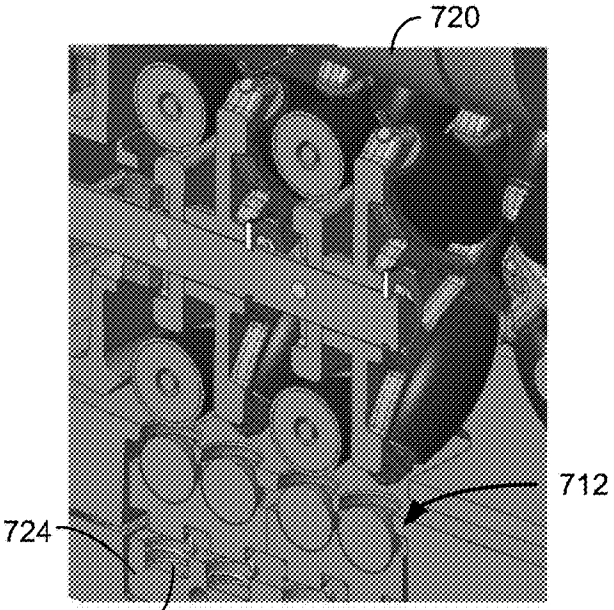

FIG. 7 illustrates omnidirectional wheels, ball transfer units, and operation thereof according to some example embodiments. FIG. 4 is presented in four distinct, yet related illustrations.

The first illustration presents an omnidirectional wheel 700. The omnidirectional wheel 700 includes a shaft 702 that is rotated on one end and has rollers 704, 706 mounted on the opposite end. The rollers 704, 706 in various embodiments may be mounted in one ring, two rings, or more rings. Each ring includes a plurality of rollers 704, 706 around the circumference of the respective ring. Each roller 704, 706 is allowed to spin freely perpendicular to a direction the shaft is rotated, such as by being mounted on a beating. As such, the omnidirectional wheel 700 transports a note in a direction according to a direction the shaft 702 is driven, but allowed the note to move in a perpendicular direction when driven accordingly by another omnidirectional wheel.

Each roller 704, 706 has an outer surface that is able to provide gripping traction of notes, such as a rubber surface. However, the surface may be adapted in various embodiments for the types of notes that are to be received.

The second illustration of FIG. 7 presents a ball transfer unit 712 assembly 710. The assembly may include one or more ball transfer units 712. In some embodiments, the number of ball transfer units 712 may be in proportion to a number of rings of opposing omnidirectional wheels 700, such as two ball transfer units 712 per omnidirectional wheel 700 ring such that there is a ball transfer unit 712 on each side of a ring. In other embodiments, there may be one ball transfer unit 712 per ring or one per pair of rings.

The third illustration 720 of FIG. 7 presents a set of ball transfer units 712 mounted in a carriage 724 that are biased upwards by springs 722. The carriage 724 is moved by a solenoid as discussed above or other suitable device to apply pressure against a note opposite an omnidirectional wheel 700 that will move the note in a desired direction. The fourth illustration 730 presents the same set of ball transfer unity 712 in a raised position.

In other instances, the ball transfer units 712 are biased by the spring 722 but are not mounted in a movable carriage.

Figure 8:
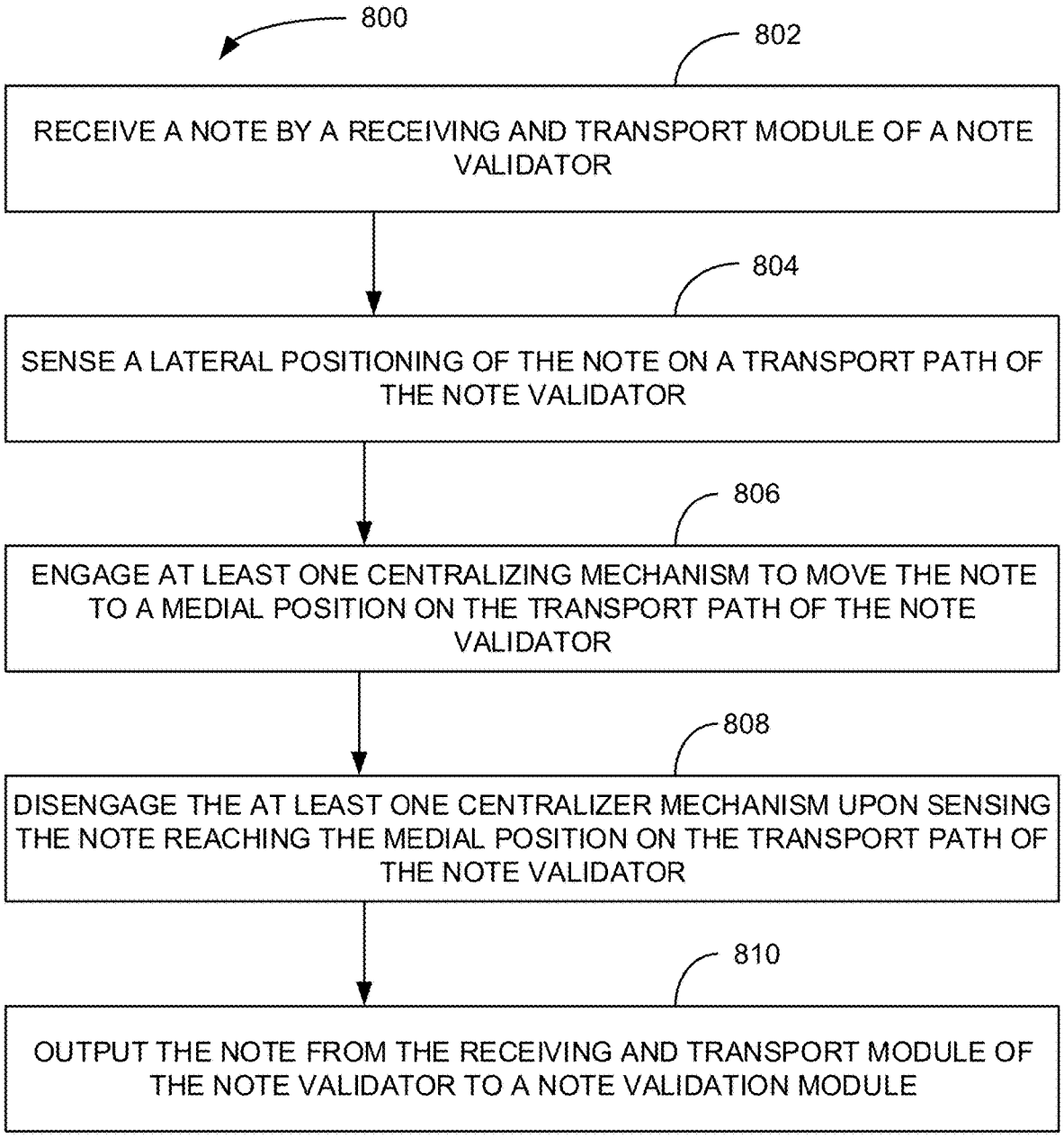
FIG. 8 is a logical block diagram of a method, according to an example embodiment.

FIG. 8 is a logical block diagram of a method 800, according to an example embodiment. The method 800 is an example of a method performed to operate a transport module of a note validator in a terminal according to an example embodiment.

The method 800 includes receiving 802 a note by a receiving and transport module of a note validator, sensing 804 a lateral positioning of the note on a transport path of the note validator, and engaging 806 at least one centralizing mechanism to move the note to a medial position on the transport path of the note validator. The method 800 may further include disengaging 808 the at least one centralizer mechanism upon sensing the note reaching the medial position on the transport path of the note validator and outputting 810 the note from the receiving and transport module of the note validator to a note validation module.

The medial position in some embodiments is centered laterally within the width of and perpendicular to the transport path.

The note validator may include two groups of a plurality of omnidirectional wheels. In such embodiments, a first group of the two groups of the plurality of omnidirectional wheels is operative to transport the note along the transport path and oriented perpendicular to a second group of the plurality of omnidirectional wheels that are operative to move the note to the medial position on the transport path of the note validator. The at least one centralizing mechanism may include the second group of the plurality of omnidirectional wheels. The second group of the plurality of omnidirectional wheel may be engaged against the note to move the note toward the medial position on the note transport path when the note is not in the medial position.

In some other embodiments, the at least one centralizing mechanism may include two centralizing mechanisms. In such embodiments, both the first and second centralizing mechanism may be powered to move a note to the medial position when selectively engaged with the note but in opposite directions of one another.

Regardless, in some of these embodiments, each omnidirectional wheel may include a plurality of rollers around the circumference of the omnidirectional wheel. Each roller in such embodiments may be mounted on a bearing or other otherwise to allow free spinning perpendicular to a direction the respective omnidirectional wheel is driven, Each omnidirectional wheel is located opposite at least one a ball transfer unit that operates to apply a pinching force on a note moving along the transport path of the note validator. The pinching force is applied between an omnidirectional wheel and a respective ball transfer unit such as to pinch a note when present therebetween.

In some of these embodiments, the pinching force includes first and second pinching forces. The first pinching force is applied by ball transfer units located opposite omnidirectional wheels of the first group of omnidirectional wheels by respective spring-loaded balls that apply a constant pinching force to move the note along the transport path. In such embodiments, the at least one centralizing mechanism includes at least one omnidirectional wheel and respective opposing at least one ball transfer unit that selectively applies the second pinching force. The second pinching force is selectively applied in such embodiments individually by at least one ball transfer unit located opposite a respective omnidirectional wheel of the second group of omnidirectional wheels to apply a selective pinching force to move the note to the medial position on the transport path. The second pinching force selectively moves a note in one of two directions opposite one another to center the note on the medial position of the transport path. In some such embodiments, engaging 806 the at least one centralizing mechanism to apply the selective pinching force includes electrifying a solenoid of a spring-loaded ball transfer unit to drive the spring-loaded ball into contact with the note when present between the spring-loaded ball of the spring-loaded ball transfer unit and the respective omnidirectional roller.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

What is claimed is:

1. A method comprising:

receiving a note by a receiving and transport module of a note validator;

sensing a lateral positioning of the note on a transport path of the note validator;

engaging at least one centralizing mechanism to move the note to a medial position on the transport path of the note validator;

disengaging the at least one centralizer mechanism upon sensing the note reaching the medial position on the transport path of the note validator;

outputting the note from the receiving and transport module of the note validator to a note validation module; and wherein:

the note validator includes two groups of a plurality of omnidirectional wheels;

a first group of the two groups of the plurality of omnidirectional wheels operative to transport the note along the transport path and oriented perpendicular to a second group of the plurality of omnidirectional wheels that are operative to move the note to the medial position on the transport path of the note validator;

each omnidirectional wheel includes a plurality of rollers around a circumference of the respective omnidirectional wheel, each roller mounted on a bearing to allow free spinning perpendicular to a direction the respective omnidirectional wheel is driven;

each omnidirectional wheel is located opposite a ball transfer unit that operates to apply a pinching force on the note moving along the transport path of the note validator, the pinching force applied between an omnidirectional wheel and a respective ball transfer unit; and the pinching force includes first and second pinching forces:

the first pinching force is applied by ball transfer units located opposite omnidirectional wheels of the first group of omnidirectional wheels by respective spring-loaded balls that apply a constant pinching force to move the note along the transport path; and the at least one centralizing mechanism includes at least one omnidirectional wheel and respective opposing at least one ball transfer unit that selectively applies the second pinching force, the second pinching force selectively applied individually by at least one ball transfer unit located opposite a respective omnidirectional wheel of the second group of omnidirectional wheels to apply a selective pinching force to move the note to the medial position on the transport path.

2. The method of claim 1, wherein the medial position is centered laterally within a width of and perpendicular to the transport path.

3. The method of claim 1, wherein the at least one centralizing mechanism includes the second group of the plurality of omnidirectional wheels that are engaged against the note to move the note toward the medial position on the note transport path when the note is not in the medial position.

4. The method of claim 1, wherein the at least one centralizing mechanism includes two centralizing mechanisms, both first and second centralizing mechanisms to move the note to the medial position when selectively engaged with the note but in opposite directions of one another.

5. The method of claim 1, wherein:

the second pinching force selectively moves a note in one of two directions opposite one another to center the note on the medial position of the transport path.

6. The method of claim 5, wherein engaging at least one centralizing mechanism to apply the selective pinching force includes electrifying a solenoid of a spring-loaded ball transfer unit to drive the spring-loaded ball into contact with the note when present between the spring-loaded ball of the spring-loaded ball transfer unit and the respective omnidirectional roller.

7. A method comprising:

receiving a note in a receiving and transport module of a self-service terminal (SST) note validator;

sensing a lateral positioning of the note on a transport path of the SST note validator, the SST note validator including two groups of a plurality of omnidirectional wheels, the first and second groups of omnidirectional wheels operative to move the note in perpendicular directions;

moving the note along the transport path with the first group of omnidirectional wheels;

engaging at least one centralizing mechanism that includes the second group of omnidirectional wheels to move the note to a lateral medial position on the transport path, the lateral medial position centered laterally within a width of and perpendicular to the transport path;

disengaging the at least one centralizer mechanism upon sensing the note reaching the lateral medial position on the transport path;

outputting the note from the receiving and transport module of the SST note validator to a note validation module; and wherein:

each omnidirectional wheel includes a plurality of rollers around a circumference of the respective omnidirectional wheel, each roller mounted on a bearing to allow free spinning perpendicular to a direction the respective omnidirectional wheel is driven; and each omnidirectional wheel is located opposite a ball transfer unit that operates to apply a pinching force on a note moving along the transport path, the pinching force applied between an omnidirectional wheel and a respective ball transfer unit, the pinching force includes first and second pinching forces:

the first pinching force is applied by ball transfer units located opposite omnidirectional wheels of the first group of omnidirectional wheels by respective spring-loaded balls that apply a constant pinching force to move the note along the transport path; and the at least one centralizing mechanism includes at least one omnidirectional wheel and respective opposing at least one ball transfer unit that selectively applies the second pinching force, the second pinching force selectively applied individually by at least one ball transfer unit located opposite a respective omnidirectional wheel of the second group of omnidirectional wheels to apply a selective pinching force to move the note to the medial position on the transport path.

8. The method of claim 7, wherein engaging at least one centralizing mechanism to apply the selective pinching force includes electrifying a solenoid of a spring-loaded ball transfer unit to drive the spring-loaded ball into contact with the note when present between the spring-loaded ball of the spring-loaded ball transfer unit and the respective omnidirectional roller.

9. A note transport mechanism of a self-service terminal (SST) comprising:

a transport path defined by two opposing mechanisms;

two groups of a plurality of omnidirectional wheels, the first and second groups of omnidirectional wheels operative to move a note in perpendicular directions within the transport path;

at least one sensor to sense a position of the note laterally in relation to a medial position on the transport path;

a ball transfer unit located opposite each of the omnidirectional wheels of both the first and second groups to apply a spring-biased pinching force against a respective omnidirectional wheel, the ball transfer units opposite the omnidirectional wheels of the first group continually biased there against and the ball transfer units opposite the omnidirectional wheels of the second group selectively biased there against to move the note perpendicular to the transport path to the medial position, and a controller to receive input from the at least one sensor regarding a position of the note on the transport path and to send signals to one or more ball transfer units to selectively apply a biasing force against one or more omnidirectional wheels of the second group to move the note laterally on the transport path to the medial position.

10. The note transport mechanism of claim 9, wherein:

each omnidirectional wheel includes a plurality of rollers around a circumference of the respective omnidirectional wheel, each roller mounted on a bearing allowing free spinning perpendicular to a direction the respective omnidirectional wheel is driven.

11. The note transport mechanism of claim 10, wherein rollers of each omnidirectional wheel include a gripping surface to engage notes.

12. The note transport mechanism of claim 11, wherein the gripping surface is rubber.

13. The note transport mechanism of claim 9, wherein the ball transfer units that selectively apply a biasing force against the omnidirectional rollers of the second group each include a solenoid that applies the biasing force when receiving an electric current that is the signal from the controller.

14. The note transport mechanism of claim 9, wherein the second group of omni directional rollers includes two rollers powered by their own respective motors that apply continuous rotational motion to the rollers, the two rollers moved in opposing directions perpendicular to the transport path.

* * * * *